US011591136B2

(12) United States Patent
Burt et al.

(10) Patent No.: US 11,591,136 B2
(45) Date of Patent: Feb. 28, 2023

(54) BOTTLE WITH DETACHABLE HOUSING AND CORRESPONDING STORAGE COMPARTMENT

(71) Applicant: Fomas, LLC, South Jordan, UT (US)

(72) Inventors: Steven Douglas Burt, South Jordan, UT (US); Thomas Craig Kline, South Jordan, UT (US); Jonathan Kent Wilson, Midvale, UT (US)

(73) Assignee: Fomas, LLC, South Jordan, UT (US)

( * ) Notice: Subject to any disclaimer, the term of this patent is extended or adjusted under 35 U.S.C. 154(b) by 0 days.

(21) Appl. No.: 17/229,636

(22) Filed: Apr. 13, 2021

(65) Prior Publication Data

US 2021/0316900 A1 Oct. 14, 2021

Related U.S. Application Data

(60) Provisional application No. 63/126,732, filed on Dec. 17, 2020, provisional application No. 63/009,879, filed on Apr. 14, 2020.

(51) Int. Cl.

| | |
|---|---|
| ***B65D 21/02*** | (2006.01) |
| ***B65D 23/12*** | (2006.01) |
| ***B65D 1/02*** | (2006.01) |
| ***B65D 51/24*** | (2006.01) |

(52) U.S. Cl.

CPC ..... *B65D 21/0237* (2013.01); *B65D 1/0223* (2013.01); *B65D 23/12* (2013.01); *B65D 51/242* (2013.01)

(58) Field of Classification Search

CPC .. B65D 21/0237; B65D 1/0223; B65D 23/12; B65D 51/242; B65D 83/0445; B65D 2313/02; B65D 81/3841; B65D 23/108; B65D 47/046; A45F 3/18

USPC ..... 215/6

See application file for complete search history.

(56) References Cited

U.S. PATENT DOCUMENTS

| | | | | | |
|---|---|---|---|---|---|
| 180,132 | A * | 7/1876 | Hoard et al. | B65D 1/04 | 215/6 |
| 1,451,564 | A * | 4/1923 | Edmister | B65D 23/108 | 294/31.2 |
| 1,539,201 | A * | 5/1925 | Ottow | B65D 23/108 | 294/31.2 |
| D100,412 | S * | 7/1936 | Carp | D9/744 | |
| 3,275,366 | A * | 9/1966 | Hidding | B65D 23/108 | 294/31.2 |
| 3,687,593 | A * | 8/1972 | Gilbert | B29C 49/4817 | 425/531 |

(Continued)

*Primary Examiner* — Ernesto A Grano

(74) *Attorney, Agent, or Firm* — Keller Preece PLLC

(57) ABSTRACT

The present disclosure relates to a bottle with a detachable housing and corresponding storage compartment. Indeed, the disclosed bottle can include a receptacle formed within an exterior side surface (or sidewall) or as part of the bottle lid. Within the receptacle, the disclosed bottle can integrate a detachable housing with the bottle via one or more attachment mechanisms (e.g., magnets). For instance, the disclosed bottle attaches the detachable housing to a receptacle sidewall such that the disclosed bottle can maintain a generally uniform profile across the exterior side surface. The detachable housing can include a storage compartment for storing and/or securing one or more items, such as cutlery, medicine, personal hygiene items, etc.

20 Claims, 13 Drawing Sheets

(56) References Cited

U.S. PATENT DOCUMENTS 3,732,999 A * 5/1973 Rounkles ..... B65D 1/04 215/6
4,010,862 A * 3/1977 Gilbert ..... A61M 5/1417 215/399
4,235,343 A * 11/1980 Thompson ..... B65D 21/0237 215/10
4,301,935 A * 11/1981 Gokcen ..... B65D 23/003 215/399
5,050,757 A * 9/1991 Hidding ..... B65D 21/0237 220/23.83
5,065,875 A * 11/1991 Balavich ..... B65D 23/12 215/10
5,316,398 A * 5/1994 Chandaria ..... B65D 21/0237 132/297
5,351,851 A * 10/1994 Powell ..... B65D 23/12 215/6
D362,799 S * 10/1995 Noble ..... D9/522
6,098,794 A * 8/2000 Lin ..... A47G 19/2227 206/217
7,178,533 B2 * 2/2007 Andrion ..... B65D 23/12 132/308
7,845,145 B2 * 12/2010 Schroeder ..... B65D 23/12 53/396
8,033,409 B2 * 10/2011 Lindemann ..... B65D 23/12 220/4.21
9,290,302 B2 * 3/2016 Horn ..... A61J 7/0481
D802,443 S * 11/2017 Ahlm ..... D9/744
9,856,053 B2 * 1/2018 Pisarevsky ..... B65D 21/0237
10,301,054 B2 * 5/2019 Pell ..... A47G 19/2205
11,066,219 B1 * 7/2021 Bakovsky ..... B65D 43/164
2004/0226904 A1 * 11/2004 Schroeder ..... B65D 21/0231 215/6
2008/0049414 A1 * 2/2008 McKay, Sr. ..... G01N 21/6447 362/96
2008/0230508 A1 * 9/2008 Overgaard ..... A45F 3/16 215/386
2008/0296181 A1 * 12/2008 Stephens ..... B65D 1/04 206/217
2014/0209489 A1 * 7/2014 Horn ..... A61J 7/0481 206/216
2016/0198874 A1 * 7/2016 Pisarevsky ..... A61J 7/04 206/217
2017/0225821 A1 * 8/2017 Hynes ..... B65D 21/0237
2018/0050838 A1 * 2/2018 Vlahakis ..... B65D 21/0237
2018/0263404 A1 * 9/2018 Pisarevsky ..... A47J 31/0615
2019/0061984 A1 * 2/2019 Pell ..... A47G 19/2205
2020/0189793 A1 * 6/2020 Clifford ..... B65D 21/0237

* cited by examiner

BOTTLE WITH DETACHABLE HOUSING AND CORRESPONDING STORAGE COMPARTMENT

CROSS-REFERENCE TO RELATED APPLICATIONS

The present application claims the benefit of U.S. Provisional Application Nos. 63/009,879 and 63/126,732, respectively filed on Apr. 14, 2020 and Dec. 17, 2020. The aforementioned applications are hereby incorporated by reference in their entirety.

BACKGROUND

Consumers are increasingly conscious of the health risks that they face by interacting with others and consuming food and beverages that they have not prepared themselves. For example, research has shown that cutlery, condiments, and accessories made available at restaurants are often infected with viruses and bacteria. Such items have often been touched by numerous persons before the consumer uses it to eat food, whether it is provided at the table, or in a container from which a consumer retrieves it (after innumerable others have done the same).

Consumers are also increasingly conscious of the environmental impact of their activities. Billions of plastic items are discarded each year, many of which find their way into the environment where they pose a threat to animal and plant life. Such waste can also take hundreds of years to break down. Accordingly, many consumers desire to incorporate environmentally friendly products in their daily activities and/or reuse items to reduce waste.

In addition, many consumers have embraced carrying various types of bottles with them throughout their day. However, consumers often avoid carrying additional items out of inconvenience, fear of losing an item, insufficient carrying space, etc. For example, when camping, hiking, biking, etc., consumers typically carry only the bare essentials (e.g., water for drinking) and avoid carrying extra items like medicine, personal hygiene items, or cutlery. Accordingly, there is a need for additional integrated storage of a variety of different items in a convenient, efficient manner.

The subject matter claimed herein is not limited to embodiments that solve any disadvantages or that operate only in environments such as those described above. Rather, this background is only provided to illustrate one example technology area where some embodiments described herein may be practiced.

BRIEF SUMMARY

Aspects of the present disclosure relate to a bottle with a detachable housing and corresponding storage compartment. Indeed, one or more implementations of the disclosed bottle include a receptacle integrated within a surface (e.g., a sidewall, interior space, or lid). Within the receptacle, the disclosed bottle can integrate a detachable housing with the bottle via one or more attachment mechanisms (e.g., magnets). For instance, the disclosed bottle attaches the detachable housing to a receptacle sidewall such that the disclosed bottle can maintain a generally uniform (e.g., flush) profile across the exterior side surface. The detachable housing can include a storage compartment for storing and/or securing one or more items, such as cutlery, medicine, personal hygiene items, etc.

Additional features and advantages of one or more embodiments of the present disclosure are outlined in the following description.

BRIEF DESCRIPTION OF THE DRAWINGS

The detailed description provides one or more embodiments with additional specificity and detail through the use of the accompanying drawings, as briefly described below.

DETAILED DESCRIPTION

Figure 1:
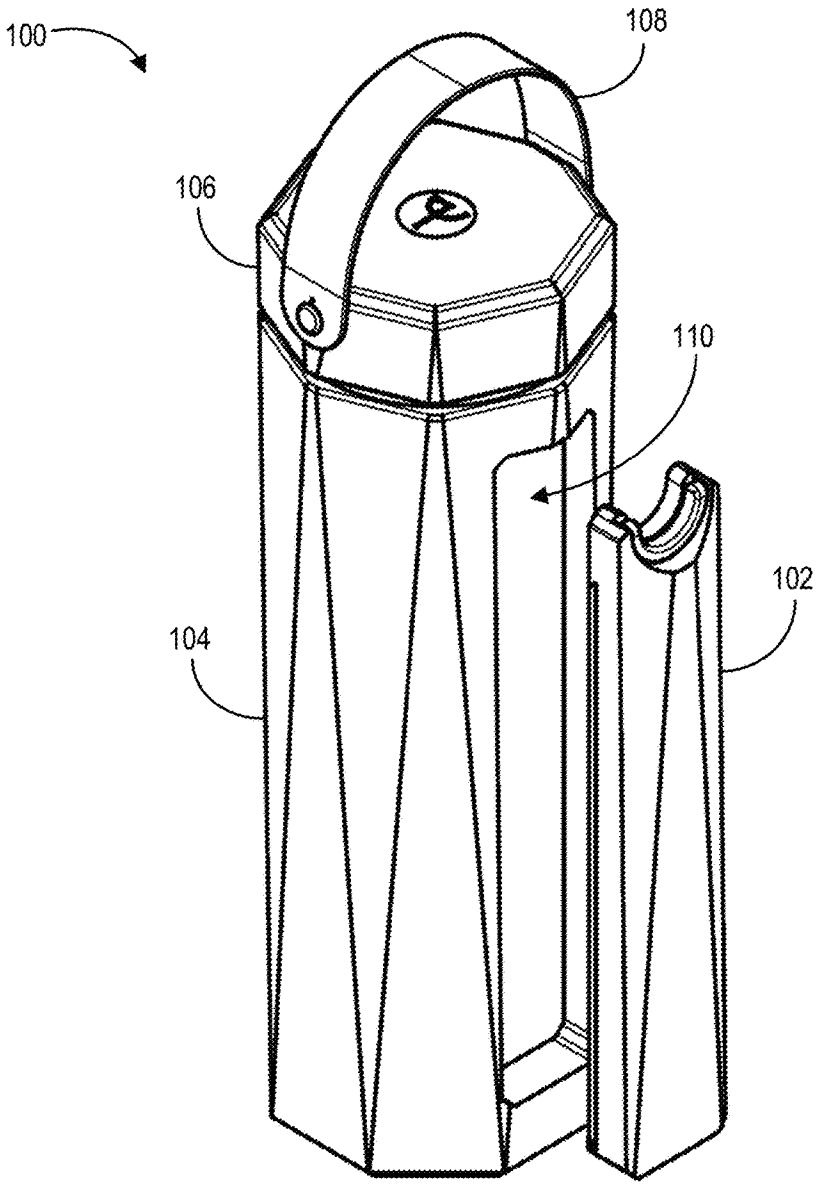
FIG. 1 illustrates an exploded view of a bottle in accordance with one or more embodiments.

This disclosure describes one or more embodiments of a bottle with a detachable/removable housing and corresponding storage compartment. For example, the bottle includes a cutout (or receptacle) formed in the outer surface of the bottle such that the detachable housing can fit inside the cutout and attach to the bottle. In certain embodiments, the detachable housing is geometrically sized and shaped to fit within the cutout in a manner that preserves the overall shape and design of the bottle. For instance, in certain implementations, the detachable housing is flush with the outer surface of the bottle when the detachable housing is inserted into the cutout. In some embodiments, the detachable housing comprises a storage compartment configured to store at least one of a variety of different items, such as cutlery (e.g., a spoon, fork, knife, chopsticks, etc.), medicine, and/or hygiene items. Further, in some embodiments, the detachable housing includes a cover that opens and closes for accessing and enclosing the storage compartment. In this manner, the bottle can efficiently and conveniently integrate storing one or more items in addition to the food or beverage inside a bottle enclosure.

As indicated by the foregoing discussion, the bottle in this disclosure includes a variety of different features. Specific feature details of the bottle are described further below in relation to the figures. However, the following description provides a brief overview of some of these features. For example, the bottle includes a sidewall (e.g., a containing wall) that extends substantially perpendicular to a base of the bottle. A sidewall can extend between a base (e.g., bottom) of the bottle up to an opening of the bottle into a bottle enclosure that stores food or beverage. In these or other embodiments, a sidewall is single-walled, double-walled, etc. In certain implementations, the bottle comprises a vacuum insulated sidewall (e.g., a dual-layered sidewall with first and second layers separated by a vacuum insulated layer or medium substantially devoid of air).

In addition, the bottle can include a receptacle formed within the sidewall. In particular embodiments, a receptacle includes a cavity or indentation within the sidewall. For example, a receptacle includes a recess formed within the sidewall such that a receptacle sidewall protrudes inward relative to the outer surface of the sidewall and toward a central axis of the bottle that extends vertically top to base. In certain implementations, the receptacle is sized and shaped to receive a detachable housing. To illustrate, a depth or amount of depression of the receptacle sidewall allows a detachable housing to be flush with the outer surface of the sidewall when the detachable housing is inserted into the receptacle. Additionally or alternatively, the receptacle sidewall comprises one or more fillets, rounded edges, etc. to insert and/or remove the detachable housing from the receptacle with greater ease.

Further, the bottle can include a detachable housing for conveniently storing one or more items. The detachable/removable housing itself can include a variety of different embodiments. For example, the detachable housing includes numerous ways of accessing a storage compartment within the detachable housing. To illustrate, in some embodiments, the detachable housing comprises a cover that opens and closes for accessing a storage compartment. In at least one implementation, the cover slidably opens and closes (e.g., by translating in a lateral or vertical motion). In yet another implementation, the cover swings open and closed (e.g., via a hinge connection to the detachable housing). For instance, the cover can include multiple covers, where each specific cover pivots open and closed to provide individualized access to a corresponding partition of a storage compartment (e.g., a "Monday" cover to access Monday's medicine, a "Tuesday" cover to access Tuesday's medicine, and so forth). Moreover, in some embodiments, the detachable housing comprises a cover in the form of a lid (e.g., a hinged lid, a horizontally sliding lid, or a lid that is sized to receive and cover a top portion of the storage compartment).

In some embodiments, the detachable housing provides access to a storage compartment via a removable insert (e.g., with or without a cover). For example, in certain implementations, the detachable housing comprises a removable insert (e.g., a storage tray or bin) that can slide into and out of a detachable housing without a cover, thereby providing access to a storage compartment. As another example, the detachable housing comprises a removable insert accessible via a cover of the detachable housing. In this example, the removable insert comprises a storage compartment that may be sized and shaped to store a particular kit or item (though a custom fit is not required). In at least some embodiments, the removable insert is composed at least in part with foam, silicone, or other protective/padding material.

In some embodiments, a storage compartment of the detachable housing comprises certain features for storing one or more items. As one example, the storage compartment can include one or more retention mechanisms for holding or securing an item in place. For instance, the storage compartment may include Velcro® strips to strap an item in place. In other instances, the storage compartment comprises item-specific molding such that the storage compartment comprises a custom fit impression or cutout to hold an item in place. Still, in other instances, the storage compartment comprises a slot or hood that maintains a portion of an item in place within the storage compartment. Additionally or alternatively, the storage compartment can include a padded material lining an interior surface of the storage compartment (e.g., to reduce noise and/or protect an item inside the storage compartment).

In specific embodiments, a storage compartment of the detachable housing can include a sanitation assembly. For example, the storage compartment may include one or more devices that use ultraviolet light to sanitize an item stored within the storage compartment. In this example implementation, the storage compartment can also include a power supply (e.g., a battery pack) and/or power connection for providing power to the sanitization assembly.

In one or more embodiments, a power supply within the detachable housing can provide a variety of additional or alternative functionalities. For example, in some embodiments, the power supply provides power for charging electronic devices (e.g., via one or more types of USB ports). In other embodiments, the power supply provides power to a flashlight, emergency flashing beacon, etc. In some embodiments, the detachable housing itself is a light source, such as a flashlight or beacon.

In some embodiments, the detachable housing attaches to a receptacle sidewall via one or more attachment mechanisms. In particular embodiments, an attachment mechanism comprises a magnet. For example, in certain implementations, at least one of the detachable housing or the receptacle sidewall comprises one or more magnets (e.g., embedded magnets or surface magnets) that cause the detachable housing and the receptacle sidewall to join together when sufficiently close. In some embodiments, only the receptacle sidewall comprises a magnet, or only the detachable housing comprises a magnet.

Additionally or alternatively, numerous other attachment mechanisms may apply. As one example, the detachable housing and the receptacle sidewall can include corresponding Velcro® strips or dots. In another example, the detachable housing and the receptacle sidewall can include interlocking or mating features. In yet another example, at least one of the detachable housing, the receptacle sidewall, or the outer surface of the sidewall may include one or more locking features (e.g., stop pins, clips, latches, etc.) that help to prevent incidental removal of the detachable housing from the receptacle.

In these or other embodiments, the detachable housing can attach to the receptacle sidewall in several different ways. In one example, the detachable housing attaches to a receptacle sidewall such that a cover of the detachable housing is flush with an exterior surface of the sidewall (e.g., such that the cover is "face-out"). In another example, the detachable housing attaches to a receptacle sidewall such that a cover directly interfaces with or abuts the receptacle sidewall (e.g., such that the cover is "face-in"). For instance, in certain implementations, the "face-in" approach can keep a cover from being incidentally opened.

As mentioned above, in certain implementations, the detachable housing is flush with the sidewall of the bottle when the detachable housing is inserted into the receptacle. Accordingly, in some embodiments, the detachable housing includes one or more features to interact with the detachable housing when inserted into the receptacle. For example, in some embodiments, the detachable housing comprises a notch (e.g., a concave cutout or recess) along one or more edges of the detachable housing. Using the notch, a user can manually remove the detachable housing from the bottle by inserting a finger into the notch and extracting out the detachable housing from within the receptacle (e.g., by pulling outwardly away from the receptacle sidewall). Additionally or alternatively to a notch in the detachable housing, a sidewall comprises a groove to aid in extracting the detachable housing from the receptacle.

In some embodiments, the detachable housing also comprises one or more features for attaching to an accessory (e.g., a carabiner, keychain, lanyard, purse, backpack, etc.). For example, in certain embodiments, the detachable housing comprises a carry loop (e.g., a swivel ring) configured to engage with one or more accessories. In this example, the swivel ring can include a half-ring (e.g., a semi-circled ring) or a full-ring that swivels between open and closed positions. For instance, when in the closed position, at least a portion of the swivel ring is concentric with a curvature of the notch such that the swivel ring matches a recessed portion of the detachable housing. Additionally for instance, at least a portion of the swivel ring is accessible for attaching to one or more accessories when the swivel ring is in the open position. In alternative embodiments, the bottle can use a clip or other accessory attachment instead of the swivel ring. Additionally or alternatively, one or more embodiments of the detachable housing include a thru-hole for attaching a lanyard or other accessory.

In some embodiments, the detachable housing comprises one or more features for carrying or transporting the bottle (or in some cases, just the detachable housing in isolation). For example, in some embodiments, the detachable housing comprises a removeable handle configured to support carrying the bottle (or just the detachable housing). Such a removeable handle may also assist in removing the detachable housing from the receptacle. In another example, the detachable housing comprises one or more clip-in features (e.g., for clipping into a bike, ski-pole, vehicle dashboard, etc.) such that the detachable housing or the bottle as a whole can integrate with one or more objects. Like the removeable handle, the one or more clip-in features are configured to support a weight of the bottle or detachable housing while "on the go."

In addition, the bottle includes a body portion. The body portion structurally includes a majority of the bottle (except for an optional lid and a detachable housing). In particular embodiments, the body portion is composed of a sidewall (discussed above) and a base that interfaces with another object or surface (e.g., a table, desk, cup holder, or shelf). Additionally for instance, the body portion includes a sidewall or other structure that forms an opening into a bottle enclosure that stores food or beverage.

Further, the bottle can include a lid. In particular embodiments, the lid at least partially covers an opening into the bottle enclosure. Moreover, a lid can include a variety of possible lids (e.g., interchangeable lids) used individually or in combination with each other. Indeed, lids compatible with the bottle may include lids of myriad types and functionalities, such as straw lids, squirt caps, flip tops, screw caps, crown caps, snap-ons, spouts, etc. In other embodiments, the lid includes a space for storage of items or for engaging with a detachable/removable housing.

In certain implementations, the lid includes a removeable handle. For example, the removeable handle attaches to and detaches from one or more button pins positioned on the lid (e.g., by engaging and disengaging a notch hole in the removeable handle with the one or more button pins on the lid). Numerous other types of removeable handles can also apply. For instance, in certain embodiments, the removeable handle and/or lid comprises a button snap, hook, or clip to for joining the removeable handle and the lid. In certain implementations, the removeable handle is at least partially composed of leather, silicone, or suitable fabric (any of which may be interchanged with another type of material).

In addition, the bottle can include a base as previously mentioned. In particular embodiments, the base includes silicone, cork, or other suitable material to inhibit sliding, protect the bottle and interfacing objects, and/or reduce noise when setting down the bottle.

Turning to the figures, FIG. 1 illustrates an exploded view of a bottle 100 in accordance with one or more embodiments. As shown, the bottle 100 includes a detachable housing 102, a body portion 104, a lid 106, a handle 108, and a receptacle 110. In addition (or in the alternative) to these elements, the bottle 100 may include myriad other elements. Indeed, as used herein, the term "bottle" may include any container used for storing and consuming at least one of food or beverage. For example, a bottle may include a tumbler, mug, cup, flask, food jar, growler, shaker, canteen, insulated container, vacuum sealed container, etc. Accordingly, the components of the bottle 100 described below may be adapted in a variety of ways that are within the scope of the present disclosure.

As shown in FIG. 1, the bottle 100 includes the detachable housing 102. The detachable housing 102 is sized and shaped to integrate with or connect to the body portion 104 via the receptacle 110 and one or more attachment mechanisms (e.g., as described more below in relation to FIGS. 2-3). Moreover, the detachable housing 102 is sized and shaped to include a storage compartment that holds cutlery. As used herein, the term "cutlery" refers to one or more utensils for eating food. Examples of cutlery can include knives, forks, spoons, chopsticks, or any combination or variation of such items.

Additionally or alternatively to holding cutlery, the detachable housing 102 can also store one or more other items. For example, the detachable housing 102 may store medicine (and/or a medicine/pill kit), an allergy/asthma rescue kit (e.g., an EpiPen®, an inhaler), an emergency kit, a medical diagnostic tool (e.g., a glucose monitor), a personal hygiene kit, a self-defense item (e.g., pepper spray), a seasoning kit (e.g., salt, pepper, hot sauce, ketchup), a metal straw, etc. Accordingly, the detachable housing 102 may be sized and shaped (e.g., customized) to fit a variety of items.

Additionally or alternatively, the detachable housing 102 may store one or more sanitization devices. For example, the detachable housing 102 may include one or more devices that use ultraviolet light to sanitize the cutlery. In these or embodiments, the detachable housing 102 may also include a power supply (e.g., a battery pack) that powers the one or more sanitization devices.

With respect to the body portion 104, the body portion 104 comprises a sidewall (e.g., a dual-layered sidewall, a single-layered sidewall, etc.). The sidewall can be formed in a variety of designs and configurations. In addition, the sidewall can determine various size aspects of the bottle 100 (e.g., diameter, height, base diameter, opening diameter, etc.). Moreover, as described below in relation to FIGS. 2-3, the body portion 104 forms a receptacle within the sidewall for receiving the detachable housing 102.

With respect to the lid 106, the lid 106 attaches to the body portion 104 in a variety of ways. For example, the lid 106 may screw onto the body portion 104 via a threaded engagement. In another example, the lid 106 may snap onto the body portion 104 such that lid 106 is press-fit inside of and/or around a rim of an opening into a bottle enclosure. In addition, the lid 106 includes the handle 108 (e.g., a removeable handle) for convenient carrying of the bottle 100.

Modifications, additions, or omissions may be made to the embodiment illustrated and described in relation to FIG. 1 without departing from the scope of the present disclosure. For example, in some embodiments, the lid 106 may include a different lid compatible with the bottle 100, such as a lid with a pouring/drinking spout. As another example, the handle 108 may be removed, while in other embodiments, implemented with the body portion 104 (e.g., as a side handle). In yet another example, the bottle 100 incorporates a variety of different detachable housings (e.g., as described in relation to FIGS. 4A-4E, 5A-5F, 6, and 7A-7D).

Figure 3:
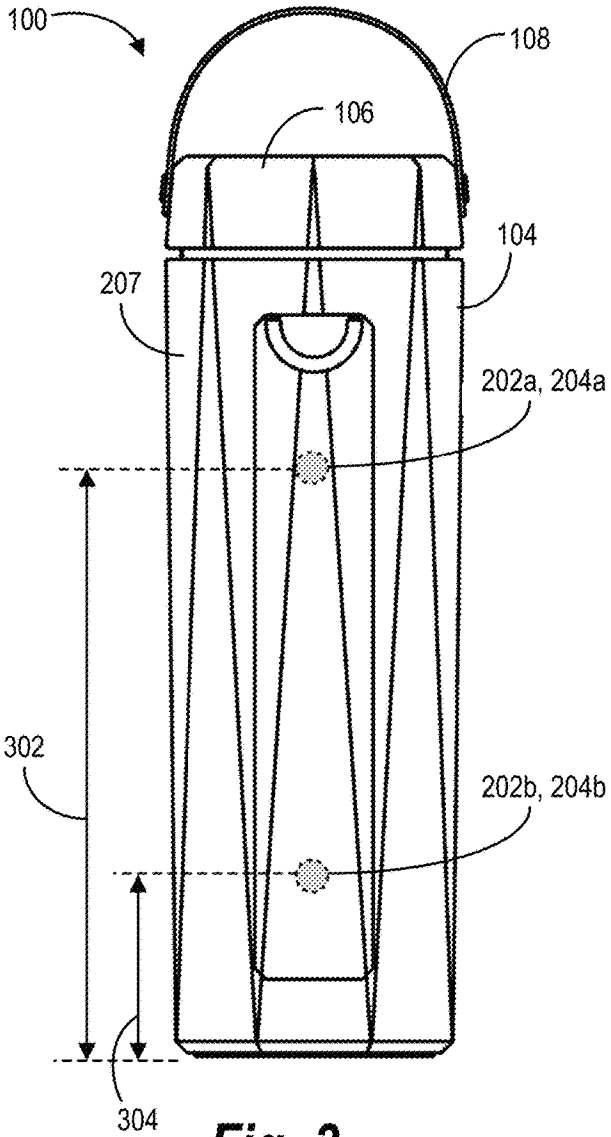
FIG. 3 illustrates a front view of a bottle in accordance with one or more embodiments.
Figure 2:
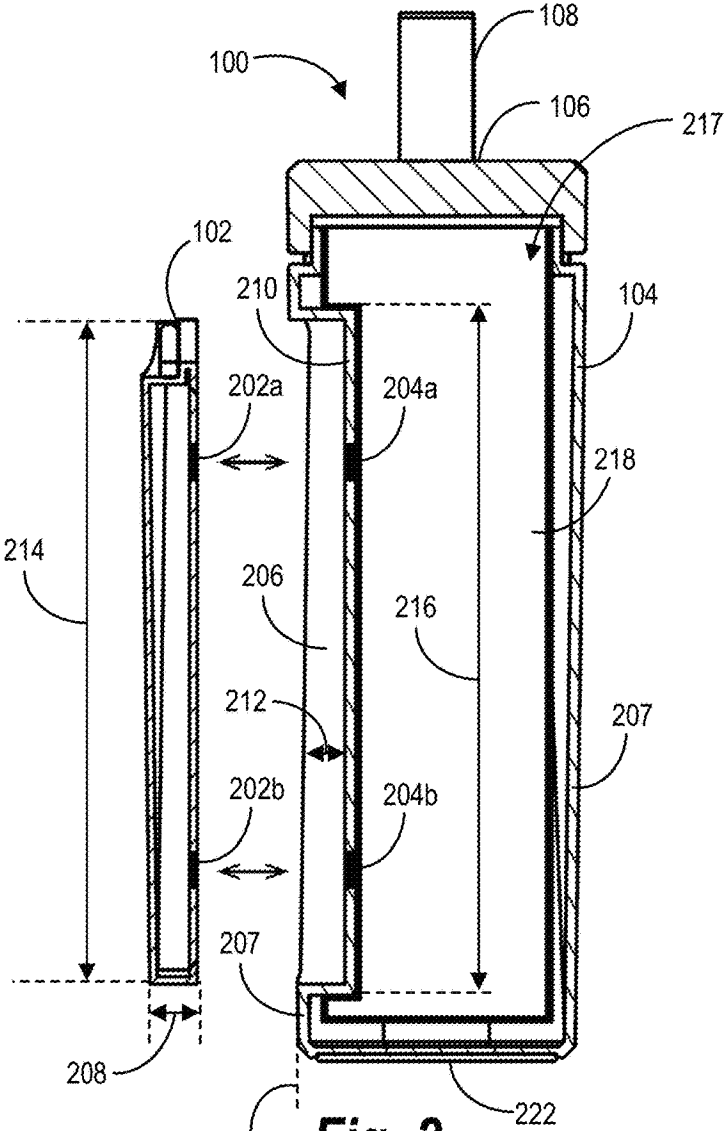
FIG. 2 illustrates a cross-sectional exploded view of a bottle in accordance with one or more embodiments.

As mentioned above, the detachable housing 102 can integrate with the bottle 100 in a convenient, efficient manner. FIGS. 2-3 respectively illustrate a cross-sectional exploded view and a front view of the bottle 100 in accordance with one or more embodiments. As shown in FIG. 2, the bottle 100 integrates the detachable housing 102 with the body portion 104 via corresponding pairs of magnets. For example, a magnet 202*a* of the detachable housing 102 is configured to align with and secure to a magnet 204*a* of a receptacle sidewall 210. Similarly, a magnet 202*b* of the detachable housing 102 is configured to align with and secure to a magnet 204*b* of the receptacle sidewall 210. As additionally shown, each of the magnets 202*a*-202*b* and the magnets 204*a*-204*b* are embedded into respective surfaces of the detachable housing 102 and the body portion 104. In other embodiments, however, one or more of the magnets 202*a*-202*b* or the magnets 204*a*-204*b* are raised above or sit on top of corresponding surfaces of the detachable housing 102 and/or the body portion 104.

As further shown in FIG. 2, the body portion 104 comprises a receptacle 206 sized and shaped to receive the detachable housing 102. In particular, the receptacle sidewall 210 bounds the receptacle 206 and protrudes inwardly (towards a bottle enclosure 218) to form a receptacle depth 212 that dimensionally matches a housing thickness 208 of the detachable housing 102. Similarly, the receptacle sidewall 210 of the receptacle 206 forms a receptacle height 216 that dimensionally matches a housing height 214 of the detachable housing 102. In this manner, the bottle 100 comprises a uniform profile such that the detachable housing 102 does not jut out or extend past a profile plane 220 when the detachable housing 102 and the body portion 104 are mated and secured together within the receptacle 206. That is, the detachable housing 102 can rest flush with a sidewall 207 of the body portion 104 when the detachable housing 102 is inserted into the receptacle 206.

In addition, FIG. 2 shows the sidewall 207 extending upwards in a substantially vertical manner from a base 222 up to a top portion of the bottle 100 for forming an opening 217 into the bottle enclosure 218. Through the opening 217, contents (e.g., food or beverage) may be placed into the bottle enclosure 218 for storing and consuming. Similarly, through the opening 217 contents may be extracted or removed from the bottle enclosure 218. In some embodiments, the sidewall 207 comprises a single sidewall layer defining the bottle enclosure 218. In other embodiments, the sidewall 207 comprises multiple sidewall layers (e.g., dual sidewall layers separated by a vacuum insulated layer) to better sustain temperatures within the bottle enclosure 218 by reducing thermal exchange.

FIG. 3 illustrates an example placement of the magnets 202*a*-202*b* and the magnets 204*a*-204*b* relative to the bottle 100. Specifically, the magnets 202*a*, 204*a* are aligned for mating at a height 302 measured from the base of the bottle 100. Similarly, the magnets 202*b*, 204*b* are aligned for mating at a height 304 measured from the base of the bottle 100. In alternative embodiments, the heights 302-304 may be varied. Further, in some embodiments, the bottle 100 may include additional magnets at other heights above, between, and/or below the heights 302-304. Still, in other embodiments, the bottle 100 may include a single magnet (e.g., at a height that is about center of the detachable housing 102).

Modifications, additions, or omissions may be made to the embodiments illustrated and described in relation to FIGS. 2-3 without departing from the scope of the present disclosure. For example, in some embodiments, the bottle 100 utilizes additional or alternative means of attachment to secure the detachable housing 102 inside the receptacle 206 of the body portion 104. To illustrate, instead of magnets, the bottle 100 may include button snaps, Velcro® strips/dots, clasps, hooks, or other suitable fasteners. As another example, the bottle 100 may include rounded corners, fillets, or other adjusted geometry than illustrated (e.g., to accommodate for easier insertion/extraction of the detachable housing 102).

As additional examples of alternative embodiments, the bottle 100 can include different configurations of magnets (or other attachment mechanisms). For instance, in some embodiments, only the detachable housing 102 comprises a magnet, or only the receptacle sidewall 210 comprises a magnet.

Still further, in some embodiments, the detachable housing 102 does not rest flush with the sidewall 207 when the detachable housing 102 is inserted into the receptacle 206. For instance, in certain implementations, the detachable housing 102 protrudes out beyond the profile plane 220 such that the detachable housing 102 alters the profile of the bottle 100.

Additionally, in some embodiments, the receptacle 206 and the detachable housing 102 are sized and shaped differently than illustrated. For example, heights, widths, depths, and/or other geometries of the detachable housing 102 and the receptacle 206 may be adapted to storing different item(s) within a storage compartment of the detachable housing 102. For instance, in some embodiments, the receptacle sidewall 210 may be changed to lengthen the receptacle height 216 as extending all the way down to a base of the bottle 100 (thereby allowing for a taller detachable housing 102). Similarly, in other embodiments, the detachable housing 102 may be a different shape (e.g., may be ovular, circular, triangular, or some other shape).

Additionally or alternatively, in some embodiments, the bottle 100 includes one or more stabilizers to increase a stability of the bottle 100. For example, to offset a weight of the detachable housing 102 and/or item(s) stored in the detachable housing 102 (particularly for when the bottle enclosure 218 is empty), the bottle 100 may include one or more counterbalance weights embedded into the sidewall 207 on an opposite side of the bottle 100 from the receptacle 206. Additionally or alternatively, the bottle 100 may include one or more anchor weights embedded into the sidewall 207 at the base 222 to lower a center of mass for the bottle 100 (e.g., to reduce undesirable tipping of the bottle 100). Alternatively, the bottle 100 may include a second detachable housing opposite a first detachable housing to more effectively balance the bottle 100.

As mentioned above, a detachable housing can include a storage compartment for conveniently storing cutlery and/or other items within a bottle. FIGS. 4A-4E respectively illustrate a side cross-sectional view, a back view, a front view, a perspective view, and an additional perspective view of a detachable housing 400 in accordance with one or more embodiments. As shown, the detachable housing 400 comprises a cover 402, an abutment face 404, a storage compartment 406, and a notch 408.

Figures 4A, 4B, 4C, 4D:
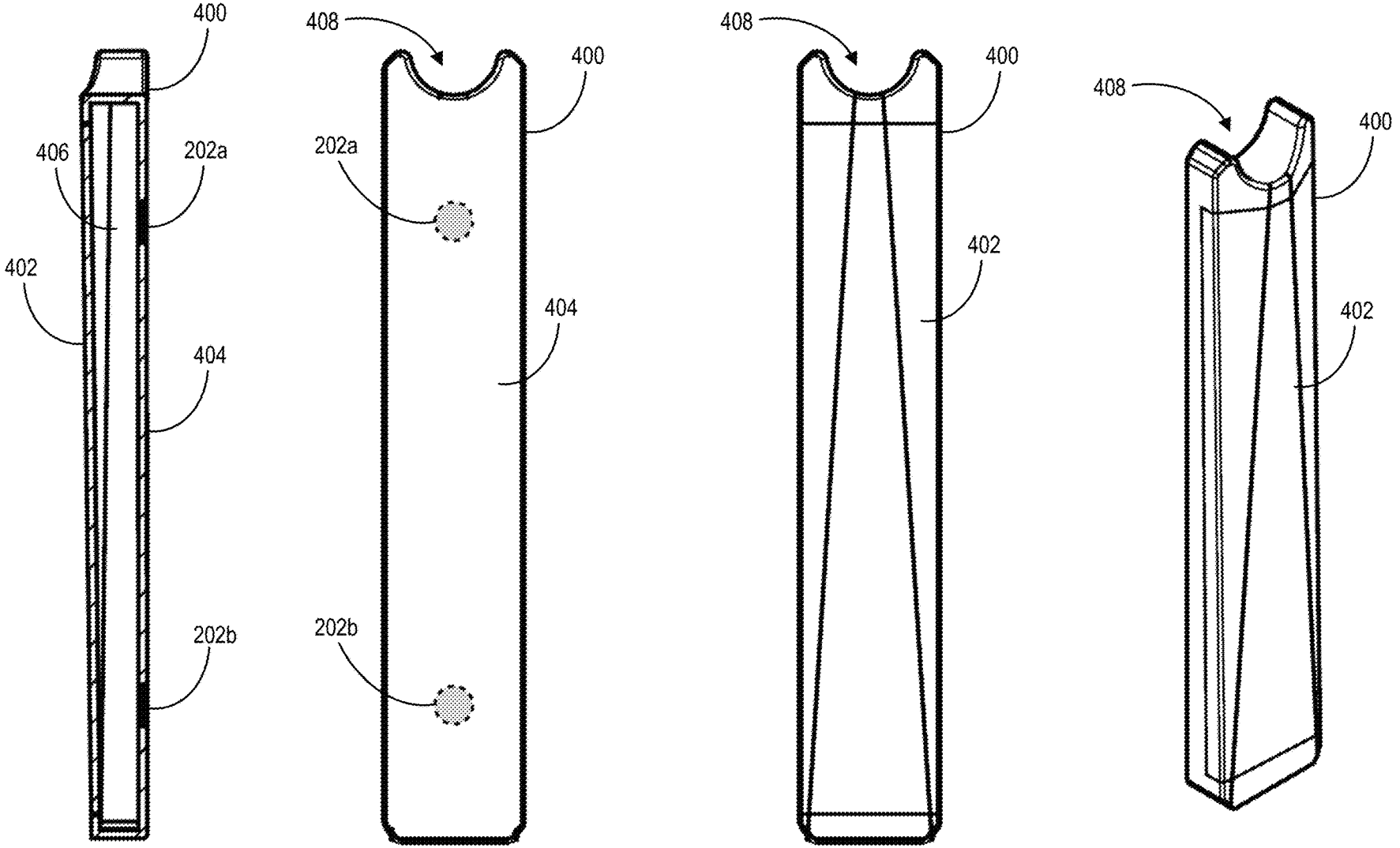
FIGS. 4A-4E illustrate various views of a detachable housing in accordance with one or more embodiments.
Figure 4E:
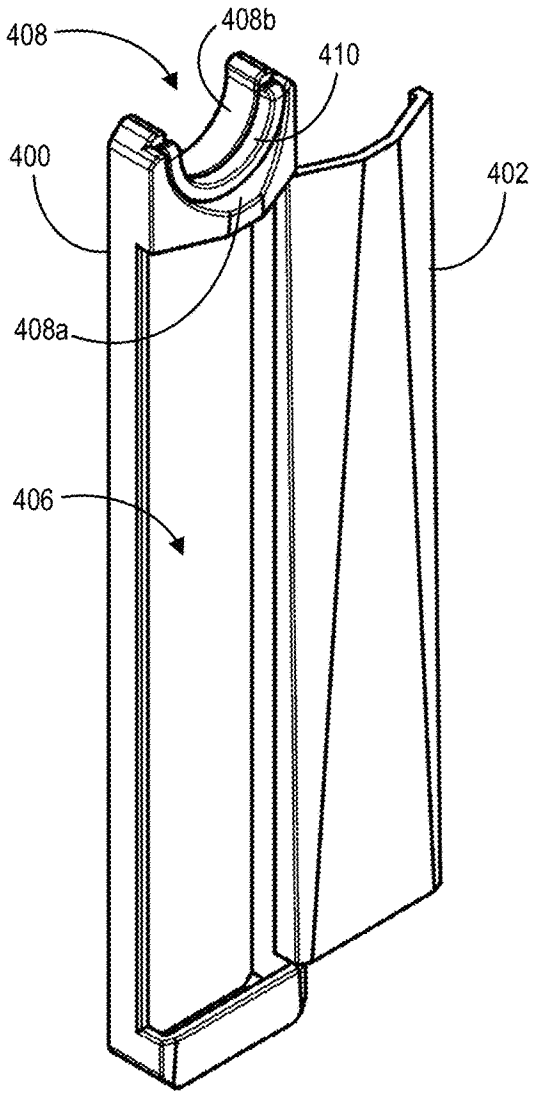

As shown, the cover 402 is a moveable cover that encloses the storage compartment 406 and one or more items inside the storage compartment 406 when the cover 402 is closed shut (e.g., as shown in FIG. 4C). In contrast, when the cover 402 is opened (e.g., as shown in FIG. 4E), the storage compartment 406 is exposed for accessing and/or storing one or more items.

The storage compartment 406 is accessible in a variety of ways. In some embodiments, the cover 402 is slidably opened such that the cover 402 translates in a lateral motion (as depicted in FIG. 4E). One example advantage of this configuration is that receptacle sidewall 210 can help prevent the cover 402 from incidentally opening when the detachable housing 400 is stowed within the receptacle 206. In other embodiments, the cover 402 is rotatably opened (e.g., via a hinge connection to the detachable housing 400). These and other embodiments of a cover are discussed below in relation to FIGS. 5A-5F and 7A-7D.

As further shown, the detachable housing 400 comprises the abutment face 404. In particular embodiments, the abutment face 404 comprises the surface that interfaces with the receptacle sidewall 210. Thus, as shown in FIGS. 4A-4B, the abutment face 404 comprises the magnets 202*a*-202*b* described above for securing the detachable housing 400 to corresponding magnets embedded into the receptacle sidewall 210 of the body portion 104.

Additionally shown, the detachable housing 400 comprises the notch 408 formed by a cutout in a top portion of the detachable housing 400. Via the notch 408, a user can manually remove the detachable housing 400 by inserting a finger into the notch 408 and pulling the detachable housing 400 away from the body portion 104. In other embodiments, the detachable housing 400 may include additional notches 408 and/or differing placement of the notches 408.

Alternatively, the detachable housing 400 may include no notch 408. Rather, the detachable housing 400 may be attached to the body portion 104 in a spring-loaded manner such that, upon a push insertion to the detachable housing 400, the detachable housing 400 pops out from the receptacle 206 of the body portion 104.

In some embodiments, the detachable housing 400 comprises additional or alternative features. For example, as shown in FIG. 4E, the detachable housing 400 comprises a swivel ring 410 that swivels relative to the notch 408. In one or more embodiments, the swivel ring 410 is configured to engage with one or more accessories, such as a carabiner, keychain, lanyard, purse, backpack, etc. For example, the swivel ring 410 is accessible for attaching to one or more accessories when the swivel ring 410 is in an open position (not shown).

As depicted in FIG. 4E, the swivel ring 410 is in a closed position such that the swivel ring 410 is concentric with the notch 408. The swivel ring 410 can be concentric with the notch 408 in a variety of ways. For example, a curvature of the swivel ring 410 can rest atop an entire curvature of the notch 408 in a concentric fashion. As another example (which is indicated in FIG. 4E), the notch 408 comprises a front notch portion 408*a* cutout at a deeper depth than a back notch portion 408*b*. In certain implementations, the difference in depth between the front notch portion 408*a* and the back notch portion 408*b* of the notch 408 is approximately equivalent to a thickness or diameter of the swivel ring 410. Thus, as shown in FIG. 4E, the swivel ring 410 is concentric with a curvature of the front notch portion 408*a* when the swivel ring 410 is in the closed position. In addition, a curvature of the back notch portion 408*b* is flush with the swivel ring 410 when the swivel ring 410 is in the closed position. Moreover, in certain implementations, the back notch portion 408*b* comprises a backstop for the swivel ring 410.

As mentioned above, the bottle of the present disclosure can include a variety of different embodiments for a detachable housing. Indeed, in some embodiments, the detachable housing comprises a cover with a plurality of individual covers that each provide access to a discrete partition (or portion) of a storage compartment. To illustrate such an example, FIGS. 5A-5F illustrate a detachable housing 500 in accordance with one or more embodiments. As shown, the detachable housing 500 comprises a swivel ring 502, a cover 504, and a notch 508.

Figures 5A, 5B, 5C, 5D, 5E, 5F:
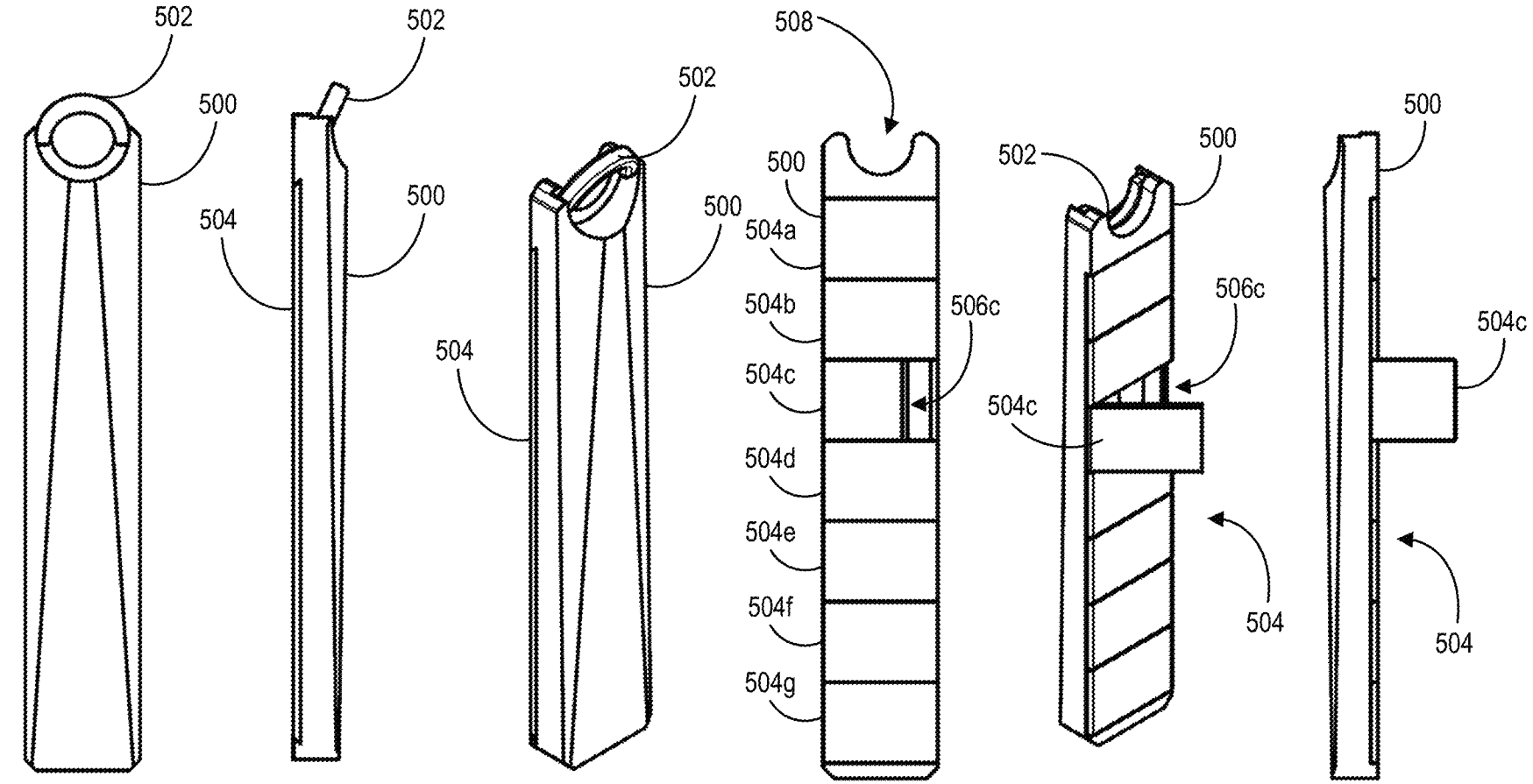
FIGS. 5A-5F illustrate various views of a detachable housing in accordance with one or more embodiments.

The swivel ring 502 is the same as or similar to the swivel ring 410 described above in relation to FIG. 4E. However, different from FIG. 4E, FIGS. 5A-5C show the swivel ring 502 in an open position ready for engaging with or connecting to one or more accessories. FIGS. 5D-5F depict the swivel ring 502 in a closed position (e.g., for inserting the detachable housing 500 into the receptacle 206).

Further shown, the detachable housing comprises the cover 504. Different from the cover 402 in FIGS. 4A-4E, the cover 504 is positioned "face-in" to directly interface with a receptacle sidewall. Also different from the cover 402 in FIGS. 4A-4E, the cover 504 comprises a plurality of covers 504*a*-504*g* configured to open and close (e.g., via hinge connections to the detachable housing 500). In particular, each cover of the plurality of covers 504*a*-504*g* provides individualized access to a corresponding partition of a storage compartment. For example, as shown in FIG. 5E, the cover 504*c* provides access to a partition 506*c* of the storage compartment, but not other partitions of the storage compartment. In this example embodiment, the storage compartment comprises dividers or inserts that engage with the plurality of covers 504*a*-504*g* to separately enclose discrete portions within the storage compartment. In this manner, the detachable housing 500 can subdivide the storage compartment (e.g., for storing medicine, different office/school supplies, food seasoning packets, coins, jewelry, etc.).

Although not illustrated in FIGS. 5A-5F, it can be appreciated that the cover 504 comprises one or more attachment mechanisms discussed above for attaching to a receptacle sidewall. Additionally or alternatively, the cover 504 may comprise one or more materials (e.g., steel) attracted to one or more magnets embedded in a receptacle sidewall.

In some embodiments, the cover 504 attaches to and detaches from a receptacle sidewall such that the plurality of covers 504*a*-504*g* do not incidentally open to spill content within the storage compartment. To illustrate, in certain implementations, the cover 504 comprises a spacer element between at least two covers of the plurality of covers 504*a*-504*g*. In this example, the cover 504 can better avoid spilling content from the storage compartment by applying an attachment mechanism that engages the spacer element of the cover 504 (instead of the plurality of covers 504*a*-504*g*).

Figure 6:
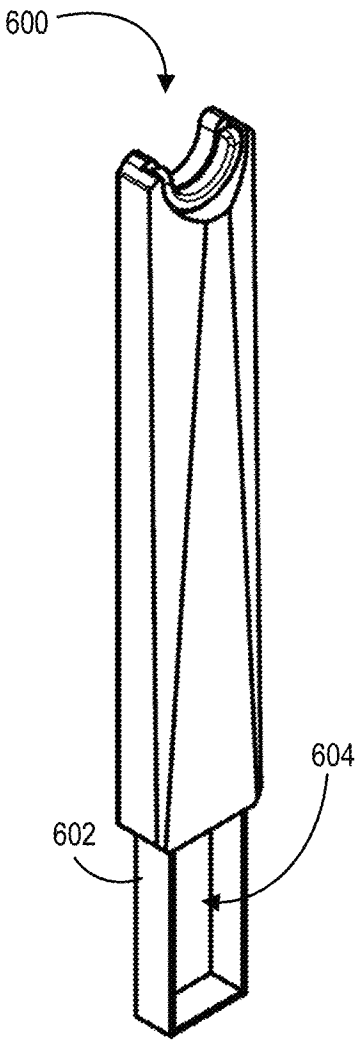
FIG. 6 illustrates a detachable housing in accordance with one or more embodiments.
Figure 7D:
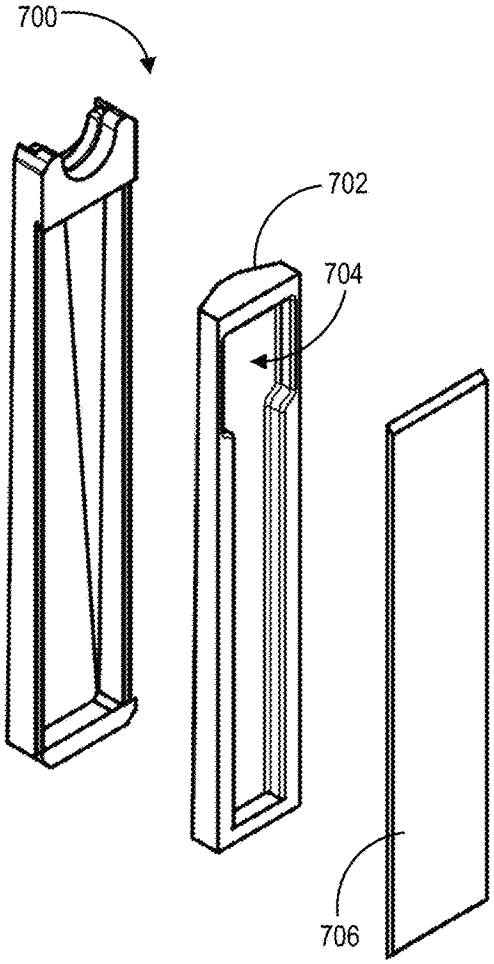
FIGS. 7A-7D illustrate various views of a detachable housing in accordance with one or more embodiments.
Figure 7C:
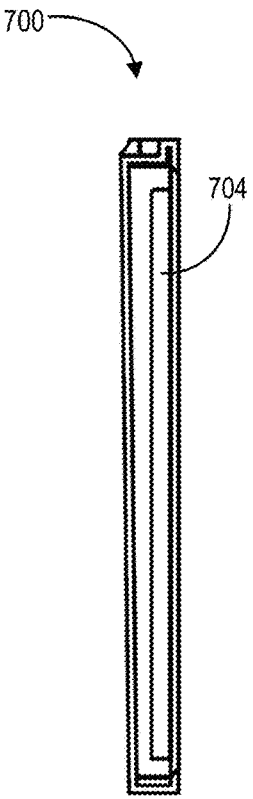
Figure 7B:
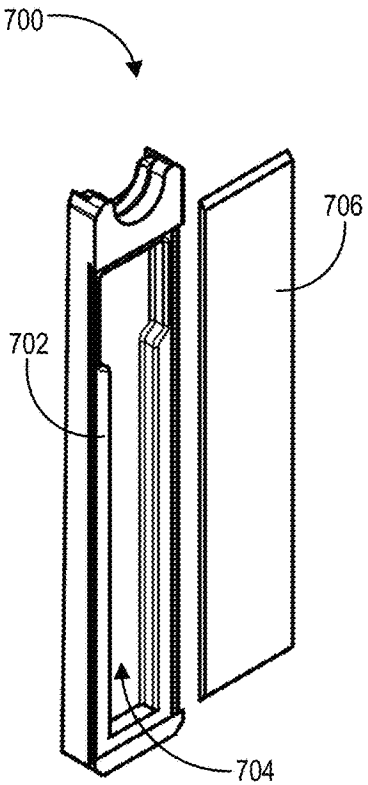
Figure 7A:
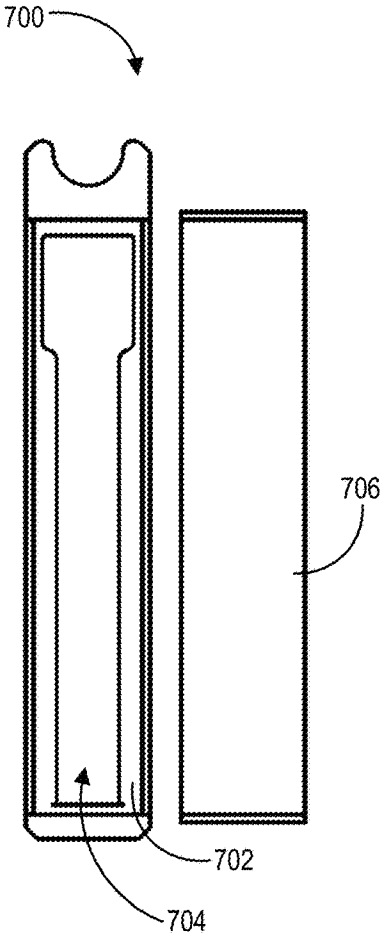

As mentioned above, one or more embodiments of the detachable housing do not implement a cover. As an example, FIG. 6 illustrates a detachable housing 600 in accordance with one or more embodiments. As shown, the detachable housing 600 comprises an insert 602 defining a storage compartment 604. In particular embodiments, the insert 602 comprises a dispenser tray or bin that slides into and out of the detachable housing 600 to provide access to the storage compartment 604. For example, in some embodiments, the insert 602 is spring-loaded such that, upon release (e.g., via a button or push-press), the insert 602 pops out from the detachable housing 600. Additionally or alternatively, in certain implementations, the detachable housing 600 comprises a mechanical stop or other feature that locks the insert 602 within the detachable housing 600. In addition, specific features of the insert 602 are described below in relation to an insert 702 of FIGS. 7A-7D.

As discussed above, certain embodiments of a detachable housing comprise an insert (e.g., to store, hold, affix, or secure an item inserted into the storage compartment). FIGS. 7A-7D illustrate a detachable housing 700 in accordance with one or more embodiments. As shown, the detachable housing 700 comprises an insert 702 with a storage compartment 704. In one or more embodiments, the insert 702 is comprises item-specific molding (e.g., a fork molding, a spoon molding, an EpiPen® molding) such that the storage compartment 704 comprises a custom fit impression or cutout to hold an item in place. Still, in other instances, the insert 702 comprises a general impression and not necessarily a fit-to-size molding. For example, as shown, the storage compartment 704 has a narrower bottom portion that opens up to a larger top region (e.g., to generally follow the shape of a fork or spoon). In other examples, the insert 702 comprises a slot or hood that maintains a portion of an item in place within the storage compartment 704.

Further, in some embodiments, the insert 702 is at least partially composed of a padded material (e.g., foam, silicone, etc.) that lines an interior surface of the storage compartment 704 (e.g., to reduce noise and/or protect an item inside the storage compartment 704). Additionally or alternatively, in certain implementations, the insert 702 is at least partially composed of an anti-bacterial (or bacteria resistant) material.

As additionally shown, the detachable housing 700 comprises a cover 706. The cover 706 is similar to the cover 402 because the cover 706 can laterally translate to slide on and off of the detachable housing 700 to reveal the storage compartment 704. However, in this example embodiment, the cover 706 is "face-in" such that the cover 706 is configured to directly interface with a receptacle sidewall when the detachable housing 700 is inserted into the receptacle. Accordingly, in certain implementations, the cover 706 comprises one or more attachment mechanisms (e.g., magnets). Additionally or alternatively, at least an outer surface of the cover 706 is composed of a material for engaging one or more attachment mechanisms in a receptacle sidewall. To illustrate, at least a portion of the outer surface of the cover 706 comprises steel or other metal for mating with one or more magnets of a receptacle sidewall. As another example, the outer surface of the cover 706 comprises Velcro® strips for engaging corresponding Velcro® strips on the receptacle sidewall.

Modifications, additions, or omissions may be made to the embodiments of a detachable housing illustrated and described in relation to FIGS. 4A-4E, 5A-5F, 6, and 7A-7D without departing from the scope of the present disclosure. Indeed, the bottle 100 can include a variety of additional or alternative embodiments of detachable housings than expressly described or illustrated in relation to the foregoing figures.

For instance, in some embodiments, a detachable housing comprises a removeable handle configured to support carrying the bottle (or just the detachable housing). In particular implementations, the detachable housing comprises a clasp, hook, or other fastener positioned on an outer surface for removably attaching the handle to the detachable housing.

In other instances, a detachable housing comprises one or more clip-in features for clipping into an object, such as a bike, ski pole, vehicle dashboard, etc. in order to support carrying the bottle (or just the detachable housing). For example, an outer surface of the detachable housing comprises a male or female clip for mating with a corresponding clip on another object.

Further, in some embodiments, a detachable housing is sized, shaped, and/or otherwise made compatible for storing inside the bottle rather than outside of the bottle. For example, in certain implementations, the detachable housing is integrated with a lid such that the detachable housing extends into a bottle enclosure containing food or beverage. Accordingly, in some embodiments, the detachable housing comprises waterproof seals or protective casing for at least partially immersing the detachable housing within the contents of the bottle enclosure.

Figure 8C:
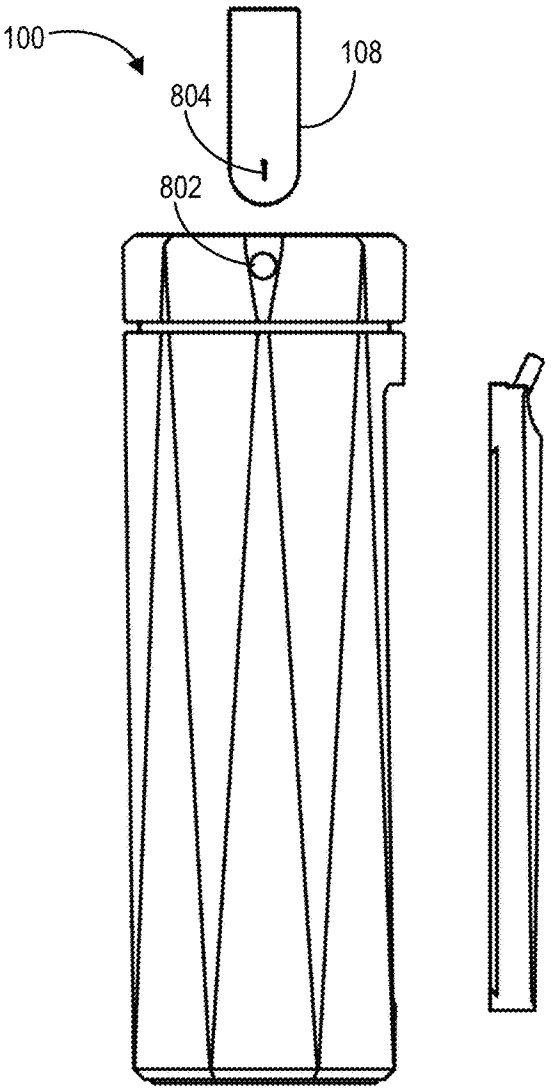
FIGS. 8A-8D illustrate a bottle comprising a removeable handle in accordance with one or more embodiments.
Figure 8B:
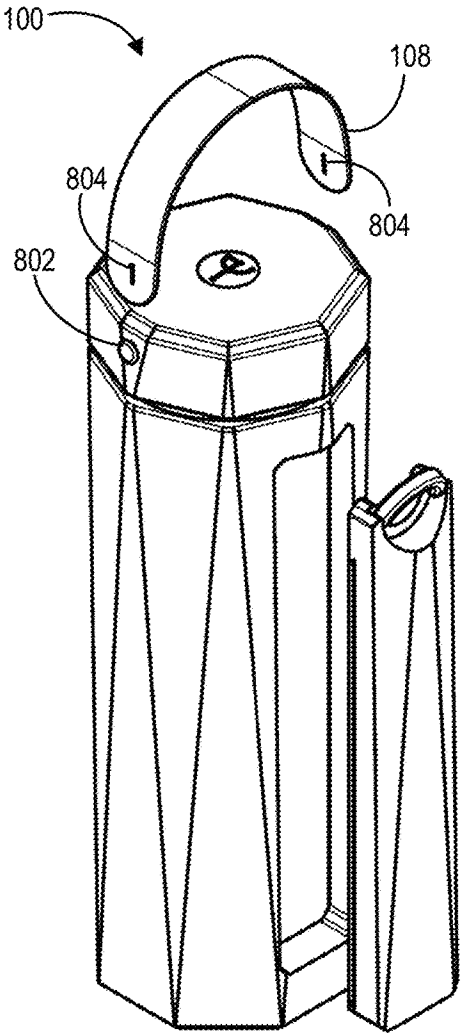
Figure 8A:
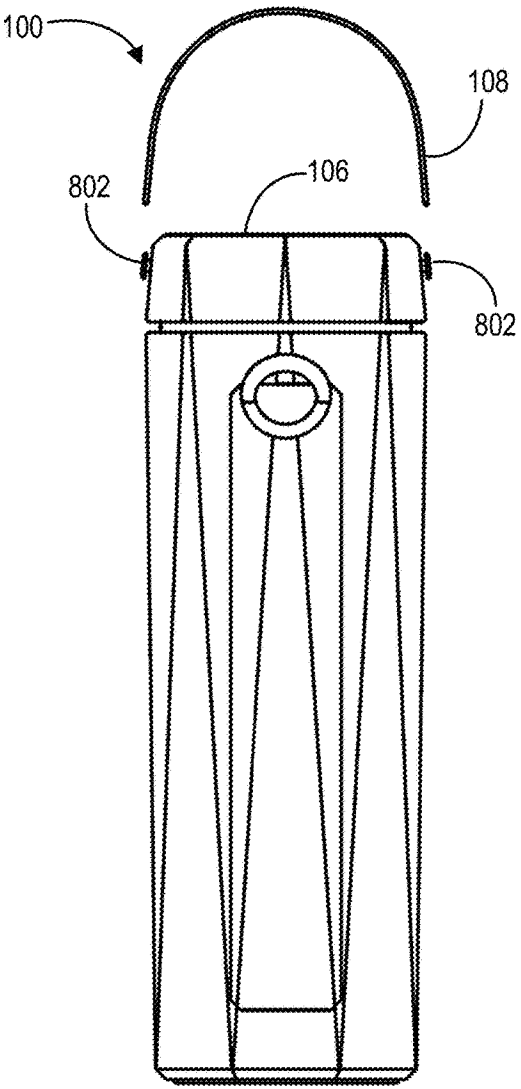

As mentioned above, a bottle of the present disclosure can include a removeable handle. FIGS. 8A-8D illustrate the bottle 100 comprising a removeable handle in accordance with one or more embodiments. As shown, FIGS. 8A-8C show an exploded view of the bottle 100 comprising the lid 106 with the handle 108 detached.

In some embodiments, the handle 108 is at least partially composed of leather, silicone, steel, or suitable fabric. The handle 108 is also adjustable and removeable. In particular embodiments, the handle 108 attaches to the lid 106 via button pins 802 described below. Additionally, in certain implementations, the handle 108 is interchangeable with other handles (e.g., of different material and/or aesthetic design).

Further, the lid 106 comprises button pins 802 that include an enlarged and/or rounded button portion connected to a dowel-pin portion that protrudes outwardly from the lid 106. In certain implementations, the button pins 802 are configured to engage with corresponding notch holes 804 on the handle 108. For example, the enlarged and/or rounded button portions of the button pins 802 may be inserted into the notch holes 804. Once inserted and attached (e.g., as shown in FIG. 8D), the handle 108 then interfaces with the dowel-pin portion of the button pins 802 between the button portion and the lid 106 in order to support or carry the bottle 100 by the handle 108.

Figure 8D:
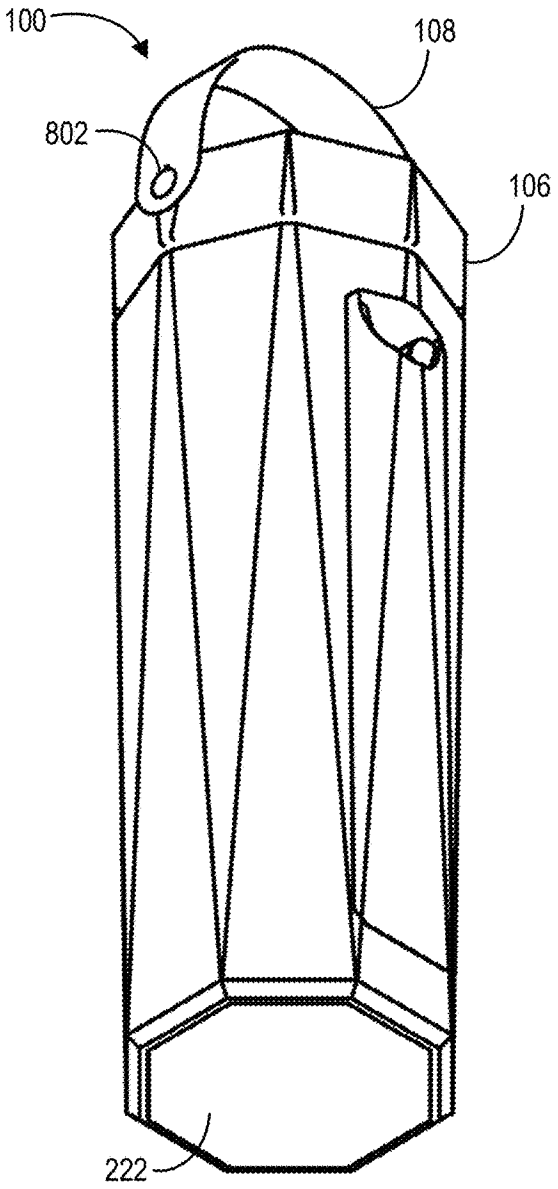

Additionally shown in FIG. 8D, the bottle 100 comprises the base 222 (briefly mentioned in relation to FIG. 2). In particular embodiments, the base 222 comprises a slip-resistant material, such as silicone or cork. In some embodiments, the slip-resistant material prevents or reduces the bottle 100 from sliding or slipping on surfaces. Further, in certain implementations, the base 222 comprises a same or different material for reducing clinking (or other noise when setting down the bottle 100). In one or more embodiments, the material of the base 222 helps to protect at least one of the bottle 100 or an interfacing surface, such as a desk.

Figure 9:
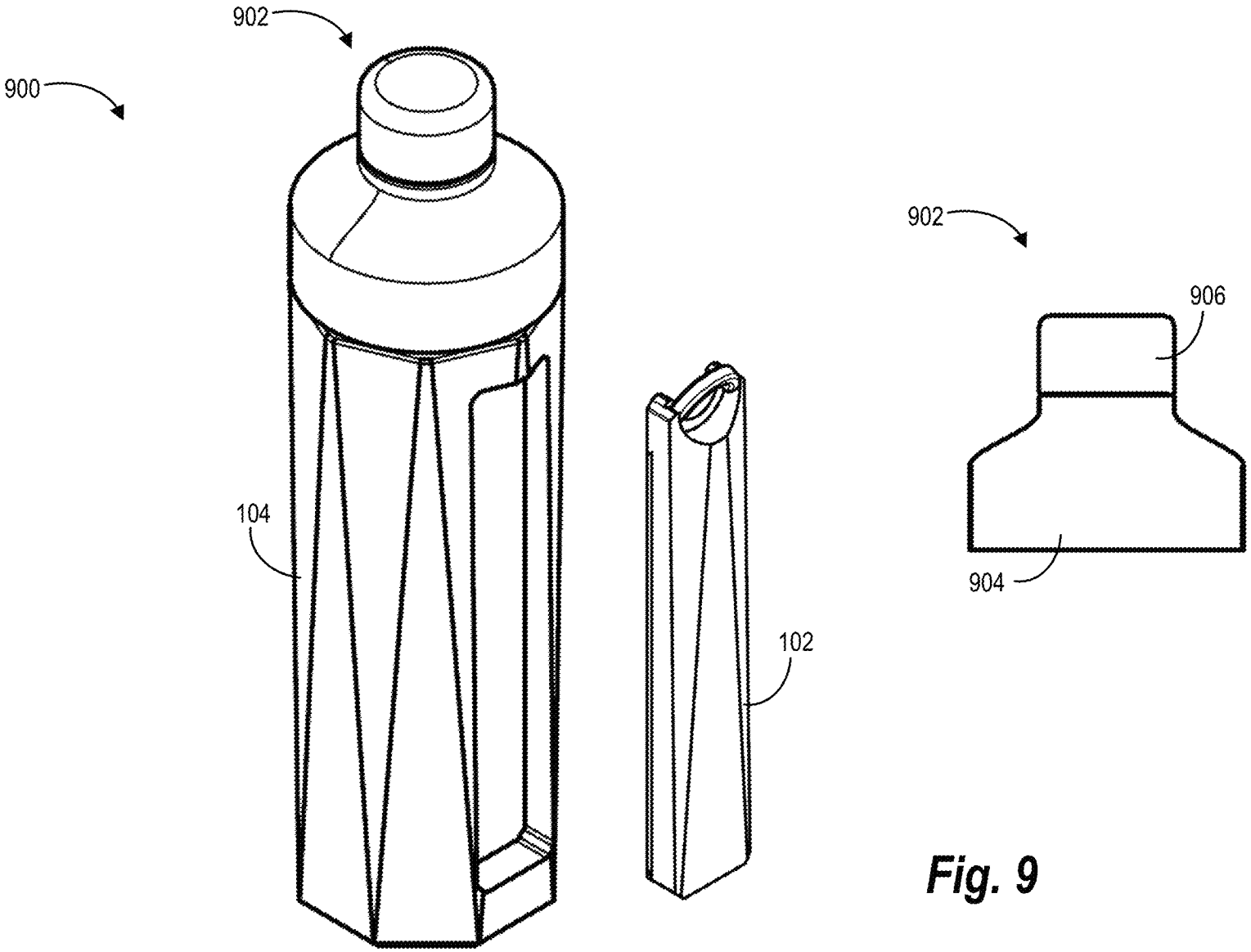
FIG. 9 illustrates a bottle in accordance with one or more embodiments.

As mentioned above, a bottle of the present disclosure can include a variety of different lids. For instance, FIG. 9 illustrates a bottle 900 in accordance with one or more embodiments. As shown, the bottle 900 comprises a same or similar version of the body portion 104 and the detachable housing 102 as shown in FIG. 1. However, unlike the bottle 100, the bottle 900 comprises a lid 902 with different features and/or functionality. In particular, the lid 902 comprises a lid base 904 and a cap 906. In some embodiments, the lid base 904 threads onto the body portion 104. In other embodiments, the lid base 904 snaps onto the body portion 104.

Similarly, in some embodiments, the cap 906 threads onto the lid base 904. In other embodiments, the cap 906 snaps onto the body portion 104. Additionally or alternatively, the lid 902 comprises myriad other components and/or functionalities. For example, the cap 906 comprises or integrates a straw, squirt cap, flip top, crown cap, spout, vent, etc.

Figure 10C:
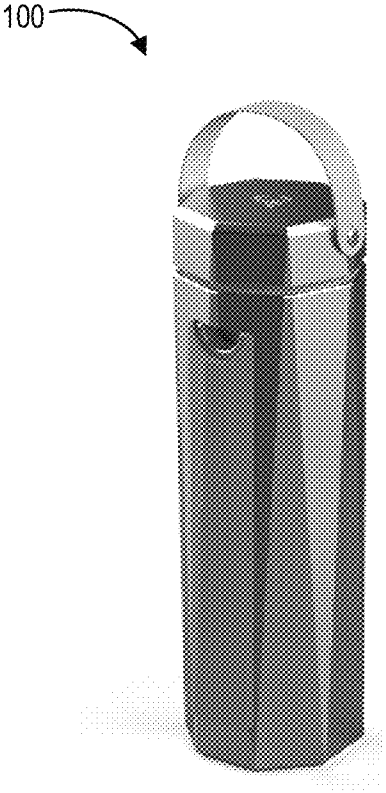
FIGS. 10A-10C illustrate additional views of a bottle in accordance with one or more embodiments.
Figure 10B:
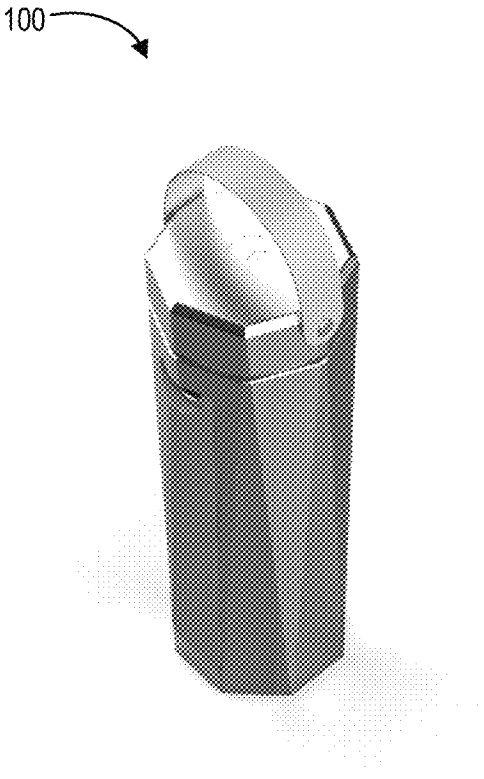
Figure 10A:
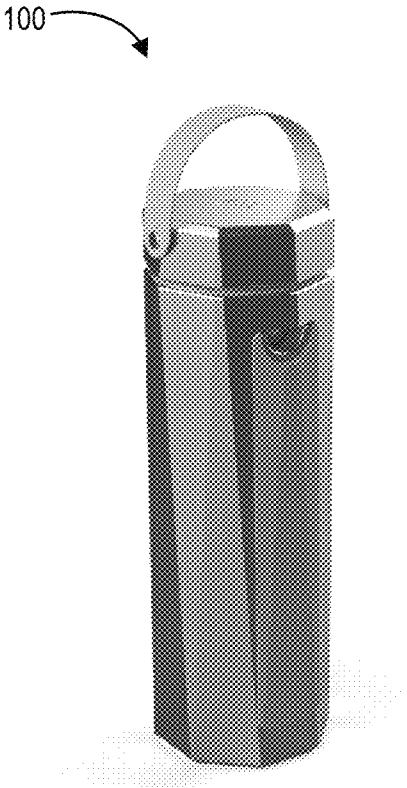

FIGS. 10A-10C illustrate additional views of a bottle in accordance with one or more embodiments. For example, FIGS. 10A-10C show example three-dimensional renderings of the bottle 100 described above.

Figure 11:
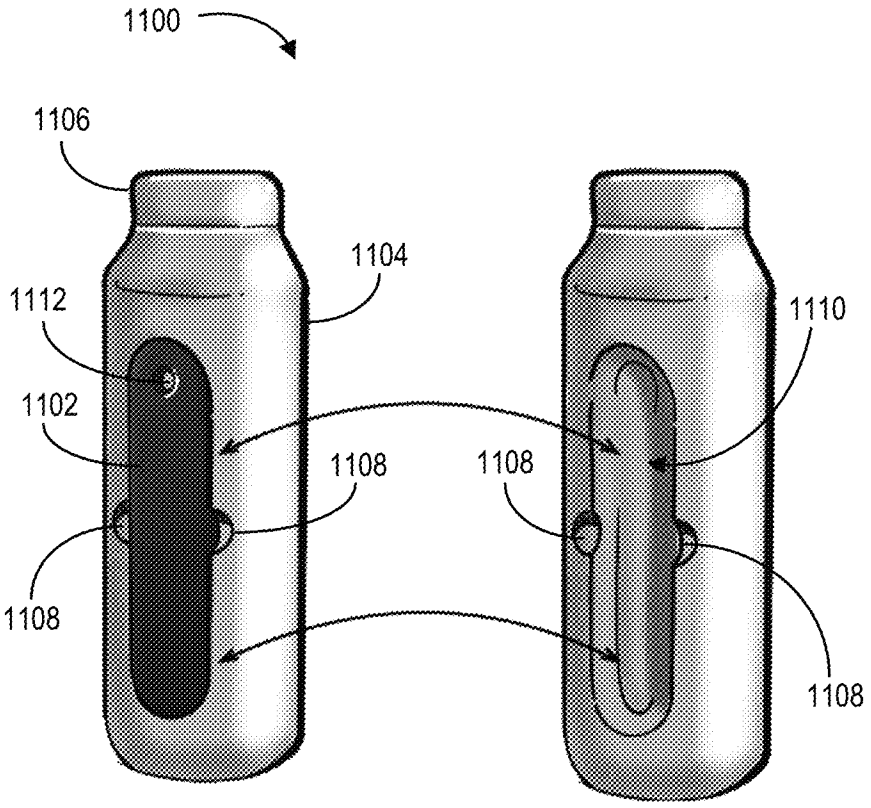
FIG. 11 illustrates a bottle in accordance with one or more embodiments.
Figure 11:
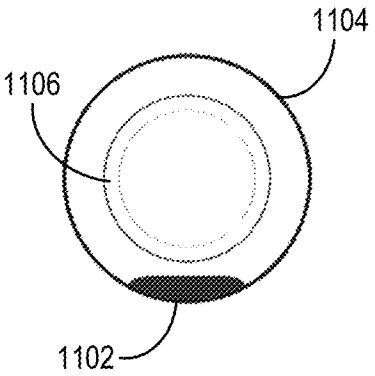

As mentioned above, one or more embodiments of a bottle disclosed in this application include a sidewall that comprises a groove to aid in extracting the detachable housing from the receptacle. FIG. 11 depicts such an example. In accordance with one or more embodiments, FIG. 11 illustrates a bottle 1100. As shown, the bottle 1100 comprises a detachable housing 1102, a body portion 1104, and a lid 1106.

The detachable housing 1102 may include the same or similar features described above for other detachable housings of the present disclosure. However, different from other detachable housings previously illustrated and described, the detachable housing 1102 comprises no notch or cutout to help extract the detachable housing 1102 from within a receptacle 1110. In addition, the detachable housing 1102 comprises a thru-hole 1112 for attaching the detachable housing 1102 to an accessory, such as a lanyard, carabiner, or keychain.

Instead of a notch in the detachable housing 1102, FIG. 11 shows the body portion 1104 comprises a pair of grooves 1108 formed in the sidewall. The pair of grooves 1108 are sized, shaped, and positioned within the sidewall of the body portion 1104 to help extract the detachable housing 1102 from within the receptacle 1110. For example, a user may place a pair of fingers (e.g., a thumb and index fingers) in the pair of grooves 1108 to pry, pinch, and/or pull on the detachable housing 1102 in order to withdraw the detachable housing 1102 from within the receptacle 1110. In alternative embodiments, the body portion 1104 comprises more or fewer grooves 1108 and/or differing positions of the grooves 1108 (e.g., a single groove along the top edge of the receptacle 1110).

Additionally shown in FIG. 11, the body portion 1104 and the lid 1106 have a smoother surface design compared to other embodiments of a bottle provided in this application. Indeed, the bottle 1100 and/or other bottles described in this application can include a variety of different shapes, designs, curvatures, surface features, etc. as may be desired. For example, the bottle 1100 and/or other bottles of the present disclosure can include grip features such as raised ribs, hand grooves, slip-on grips, etc.

One or more implementations of the present invention can also include methods of manufacturing a bottle. In accordance with one or more embodiments, a process 1200 in FIG. 12 and the accompanying description describe one or more embodiments of such methods. One of ordinary skill in the art will recognize that the methods described below can be modified. For example, various acts of the method described can be omitted or expanded, additional acts can be included, and the order of the various acts of the method described can be altered as desired.

Indeed, one or more acts in the process 1200 may be combined with various bottle manufacturing steps. For example, the process 1200 may be combined with one or more example processes such as pipe cutting, expansion (e.g., water expansion or stretching), separating, shaping, necking, thread rolling, cleaning, inspection, welding, combining inner and outer bottles, leak testing, vacuuming, temperature testing, insulation testing, electrolysis polishing, mechanical polishing, coating, pattern/logo printing, etc. Additionally or alternatively, one or more acts in the process 1200 may be combined with one or more example processes such as injection molding, polymer casting, rotational molding, vacuum forming, extrusion, blow molding, CNC machining, three-dimensional printing, etc.

In these or other embodiments, the process 1200 may be performed utilizing a variety of materials. One example material includes steel (e.g., 304 stainless steel, 201 stainless steel). Another example material includes copper and copper alloys. Another example material includes various types of plastic (e.g., polyethylene terephthalate, high-density polyethylene, polyvinyl chloride, low-density polyethylene, polypropylene, polystyrene, polycarbonate, recycled plastic, etc.). As a further example, a material can include one or more types of resin. Yet another example material includes fibrous materials, such as bamboo fiber. In certain implementations, materials can also be combined. For instance, bamboo fibers can be combined with biodegradable plastic material.

Figure 12:
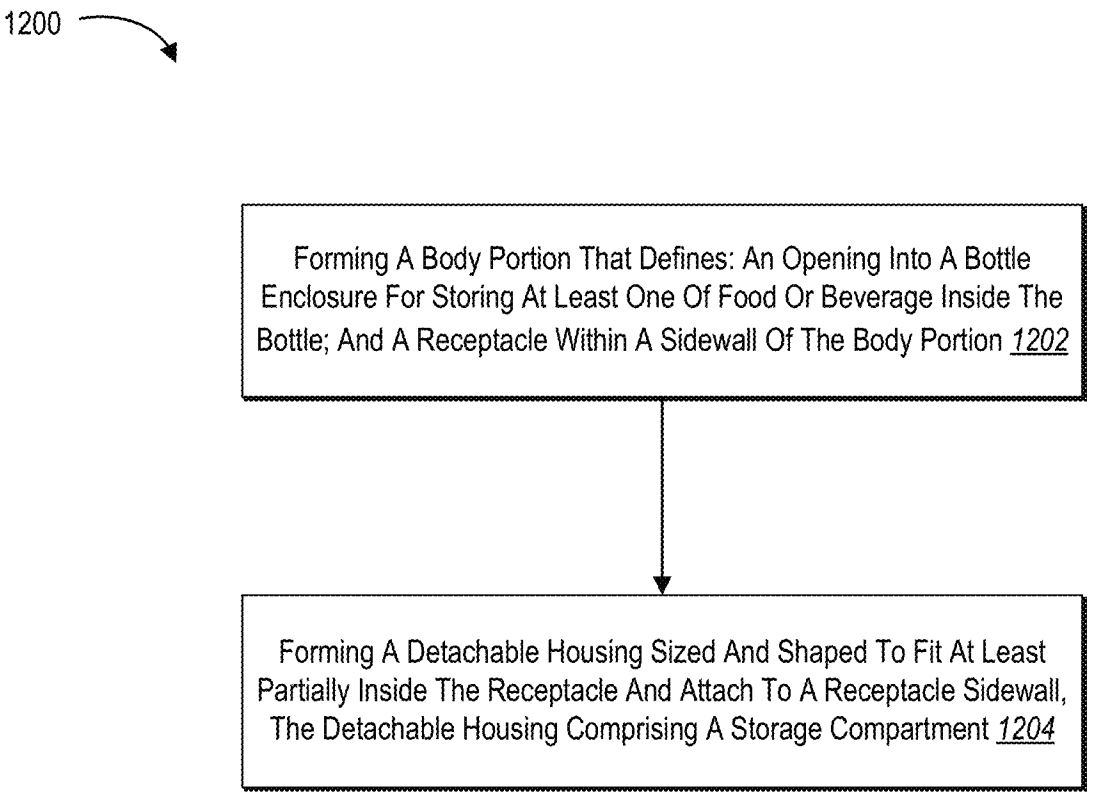
FIG. 12 illustrates a method of manufacturing a bottle in accordance with one or more embodiments.

As shown in FIG. 12, the process 1200 comprises an act 1202 of forming a body portion that defines: an opening into a bottle enclosure for storing at least one of food or beverage inside the bottle; and a receptacle within a sidewall of the body portion. In certain implementations of the act 1202, the body portion forms the receptacle within the sidewall comprising a first sidewall layer and a second sidewall layer separated by a vacuum insulated layer. Additionally or alternatively, in certain embodiments of the act 1202, the body portion forms the receptacle within the sidewall such that a receptacle sidewall protrudes inward relative to the exterior surface of the sidewall and toward a bottle enclosure for storage of at least one of food or beverage inside the bottle.

In addition, the process 1200 further comprises an act 1204 of forming a detachable housing sized and shaped to fit at least partially inside the receptacle and attach to a receptacle sidewall, the detachable housing comprising a storage compartment. In some embodiments, the detachable housing is sized and shaped to fit inside the receptacle such that an exterior surface of the detachable housing is flush with an exterior surface of the sidewall when the detachable housing is inserted into the receptacle. Additionally or alternatively, the storage compartment of the detachable housing is sized and shaped to store one or more items comprising cutlery.

In some embodiments, the act 1204 comprises forming at least one of the detachable housing or the receptacle sidewall with one or more magnets for attaching the detachable housing to the receptacle sidewall. In certain implementations, the act 1204 comprises forming the detachable housing with a removable insert that defines the storage compartment. Additionally or alternatively, in some embodiments, the act 1204 comprises forming the detachable housing with a cover; and when the detachable housing is inserted into the receptacle, the cover either attaches to the receptacle sidewall or is flush with an exterior surface of the sidewall.

In some embodiments, the act 1204 comprises forming the detachable housing with a cover that includes a plurality of covers, each cover of the plurality of covers providing individualized access to a corresponding partition of the storage compartment. Additionally or alternatively, the act 1204 comprises forming the storage compartment with at least one of: a retention mechanism for holding or securing one or more items in place; or padded material lining an interior surface of the storage compartment.

In certain implementations, the act 1204 comprises forming the detachable housing with: a notch for removing the detachable housing from within the receptacle; and a swivel ring that is positioned within the notch and swivels between a closed position and an open position, wherein the swivel ring: is concentric with a curvature of the notch when the swivel ring is in the closed position; and is accessible for attaching to one or more accessories when the swivel ring is in the open position.

As mentioned previously, it is understood that the outlined acts in the process 1200 are only provided as examples, and some of the acts may be optional, combined into fewer acts, or expanded into additional acts without detracting from the essence of the disclosed embodiments. Additionally, the acts described herein may be repeated or performed in parallel with one another or in parallel with different instances of the same or similar acts. As an example of an additional or alternative act not shown in FIG. 12, act(s) in the process 1200 may include an act of forming a lid with a handle that attaches to and detaches from button pins positioned on the lid.

As another example of an additional or alternative act not shown in FIG. 12, act(s) in the process 1200 may include an act of: forming a body portion that forms a receptacle within a sidewall of the body portion; and forming a detachable housing that: is sized and shaped to fit inside the receptacle such that an exterior surface of the detachable housing is flush with an exterior surface of the sidewall when the detachable housing is inserted into the receptacle; comprises a storage compartment for storing one or more items inside the storage compartment; and comprises a cover that opens and closes for accessing and enclosing the storage compartment.

In additional or alternative embodiments, the process 1200 may include forming or constructing one or more of the following embodiments. In one example, the process 1200 includes forming at least one of the detachable housing or the sidewall with a notch for removing the detachable housing from within the receptacle. In another example, the process 1200 includes forming a cover that either: translates in a lateral motion to slidably open and close; or is rotatably opened and closed via a hinge connection to the detachable housing. In yet another example, the process 1200 includes forming a detachable housing such that when the detachable housing is inserted into the receptacle, the cover either attaches to a receptacle sidewall or is flush with the exterior surface of the sidewall.

Further, in additional or alternative embodiments, the process 1200 may include forming or constructing one or more of the following embodiments. In a particular example, the process 1200 includes forming: a storage compartment of the detachable housing to be sized and shaped to store one or more items; and the storage compartment with at least one of: a retention mechanism for holding or securing the one or more items in place; one or more inserts or enclosures that subdivide the storage compartment; or padded material lining an interior surface of the storage compartment.

Still further, in additional or alternative embodiments, the process 1200 may include forming or constructing one or more of the following embodiments. For example, the process 1200 may include forming a receptacle sidewall with a first magnet and a second magnet for attaching the detachable housing to the receptacle sidewall. As another example, the process 1200 may include forming a detachable housing with a swivel ring that swivels between a closed position and an open position for attaching to one or more accessories.

In accordance with common practice, the various features illustrated in the drawings may not be drawn to scale. The illustrations presented in the present disclosure are not meant to be actual views of any particular apparatus (e.g., device, system, etc.) or method, but are merely idealized representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one"

or "one or more"); the same holds true for the use of definite articles used to introduce claim recitations.

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms "first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

What is claimed is:

1. A bottle for use in storing and consuming at least one of food or beverage, the bottle comprising:
- a body portion that forms:
  - an opening into a bottle enclosure for storing at least one of food or beverage inside the bottle; and
  - a receptacle within a sidewall of the body portion; and
- a detachable housing sized and shaped to fit at least partially inside the receptacle and attach to a receptacle sidewall, the detachable housing comprising:
  - a storage compartment;
  - a notch for accessing and removing the detachable housing from within the receptacle; and
  - a swivel ring that is positioned within the notch and swivels between a closed position and an open position, wherein the swivel ring:
    - is concentric with a curvature of the notch when the swivel ring is in the closed position; and
    - is accessible for attaching to one or more accessories when the swivel ring is in the open position.

2. The bottle according to claim 1, wherein the detachable housing is sized and shaped to fit inside the receptacle such that an exterior surface of the detachable housing is flush with an exterior surface of the sidewall when the detachable housing is inserted into the receptacle.

3. The bottle according to claim 1, wherein the storage compartment of the detachable housing is sized and shaped to store one or more items comprising cutlery.

4. The bottle according to claim 1, wherein at least one of the detachable housing or the receptacle sidewall comprises one or more magnets for attaching the detachable housing to the receptacle sidewall.

5. The bottle according to claim 1, wherein the detachable housing comprises a removable insert that defines the storage compartment.

6. The bottle according to claim 1, wherein:
- the detachable housing comprises a cover; and
- when the detachable housing is inserted into the receptacle, the cover either attaches to the receptacle sidewall or is flush with an exterior surface of the sidewall.

7. The bottle according to claim 1, wherein the detachable housing comprises a cover that includes a plurality of covers, each cover of the plurality of covers providing individualized access to a corresponding partition of the storage compartment.

8. The bottle according to claim 1, wherein the storage compartment comprises at least one of:
- a retention mechanism for holding or securing one or more items in place; or
- padded material lining an interior surface of the storage compartment.

9. The bottle according to claim 1, wherein the body portion forms the receptacle within the sidewall such that the receptacle sidewall protrudes inward relative to an exterior surface of the sidewall and toward the bottle enclosure.

10. The bottle according to claim 1, further comprising a lid with a handle that attaches to and detaches from button pins positioned on the lid.

11. A bottle comprising:
- a body portion that forms a receptacle within a sidewall of the body portion; and
- a detachable housing that:
  - is sized and shaped to fit inside the receptacle such that an exterior surface of the detachable housing is flush with an exterior surface of the sidewall when the detachable housing is inserted into the receptacle;
  - comprises a notch for accessing and removing the detachable housing from within the receptacle;
  - comprises a swivel ring disposed within the notch that swivels between a closed position and an open position for attaching to one or more accessories;
  - comprises a storage compartment for storing one or more items inside the storage compartment; and
  - comprises a cover that opens and closes for accessing and enclosing the storage compartment.

12. The bottle according to claim 11, wherein the notch for accessing and removing the detachable housing from within the receptacle comprises a concave cutout or recess in the detachable housing.

13. The bottle according to claim 11, wherein the cover:
- translates in a lateral motion to slidably open and close; or
- is rotatably opened and closed via a hinge connection to the detachable housing.

14. The bottle according to claim 11, wherein when the detachable housing is inserted into the receptacle, the cover either attaches to a receptacle sidewall or is flush with the exterior surface of the sidewall.

15. The bottle according to claim 11, wherein:
- the storage compartment of the detachable housing is sized and shaped to store one or more items; and
- the storage compartment comprises at least one of:
  - a retention mechanism for holding or securing the one or more items in place;
  - one or more inserts or enclosures that subdivide the storage compartment; or
  - padded material lining an interior surface of the storage compartment.

16. The bottle according to claim 11, wherein a receptacle sidewall comprises a first magnet and a second magnet for attaching the detachable housing to the receptacle sidewall.

17. The bottle according to claim 11, wherein the body portion forms the receptacle within the sidewall comprising a first sidewall layer and a second sidewall layer separated by a vacuum insulated layer.

18. The bottle according to claim 11, wherein the body portion forms the receptacle within the sidewall such that a receptacle sidewall protrudes inward relative to the exterior surface of the sidewall and toward a bottle enclosure for storage of at least one of food or beverage inside the bottle.

19. The bottle according to claim 11, wherein the storage compartment of the detachable housing is sized and shaped to store one or more items comprising cutlery.

20. A method of manufacturing a bottle, the method comprising:

forming a body portion that defines:

an opening into a bottle enclosure for storing at least one of food or beverage inside the bottle; and a receptacle within a sidewall of the body portion; and forming a detachable housing sized and shaped to fit at least partially inside the receptacle and attach to a receptacle sidewall, the detachable housing comprising:

a storage compartment;

a notch for accessing and removing the detachable housing from within the receptacle; and a swivel ring that is positioned within the notch and swivels between a closed position and an open position, wherein the swivel ring:

is concentric with a curvature of the notch when the swivel ring is in the closed position; and is accessible for attaching to one or more accessories when the swivel ring is in the open position.

* * * * *